US010696521B2

(12) United States Patent
Gainche

(10) Patent No.: US 10,696,521 B2
(45) Date of Patent: Jun. 30, 2020

(54) ELEVATOR SYSTEM

(71) Applicants: thyssenkrupp Elevator AG, Essen (DE); thyssenkrupp AG, Essen (DE)

(72) Inventor: Philippe Gainche, Großbettlingen (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 45 days.

(21) Appl. No.: 16/311,075

(22) PCT Filed: Jun. 29, 2017

(86) PCT No.: PCT/EP2017/066141

§ 371 (c)(1),
(2) Date: Dec. 18, 2018

(87) PCT Pub. No.: WO2018/002228

PCT Pub. Date: Jan. 4, 2018

(65) Prior Publication Data

US 2019/0177125 A1 Jun. 13, 2019

(30) Foreign Application Priority Data

Jul. 1, 2016 (DE) ..... 10 2016 211 997

(51) Int. Cl.
*B66B 7/02* (2006.01)
*B66B 9/00* (2006.01)
(Continued)

(52) U.S. Cl.
CPC ..... *B66B 7/026* (2013.01); *B66B 1/26* (2013.01); *B66B 7/024* (2013.01); *B66B 9/003* (2013.01);
(Continued)

(58) Field of Classification Search
CPC ..... B66B 7/026; B66B 1/26; B66B 7/024; B66B 9/003; B66B 1/2466; B66B 1/2491;
(Continued)

(56) References Cited

U.S. PATENT DOCUMENTS 3,896,736 A * 7/1975 Hamy ..... B66B 9/003 104/127
4,043,463 A * 8/1977 Hansen ..... B65G 1/02 414/283
(Continued)

FOREIGN PATENT DOCUMENTS

CN 101318605 A 12/2008
CN 102115001 A 7/2011
(Continued)

OTHER PUBLICATIONS

English Translation of International Search Report issued in PCT/EP2017/066141, dated Sep. 25, 2017.

*Primary Examiner* — Michael A Riegelman
(74) *Attorney, Agent, or Firm* — thyssenkrupp North America, LLC

(57) ABSTRACT

An elevator system, including at least one first guide rail, which is oriented in a first, in particular vertical, direction, at least one second guide rail, which is oriented in a second, in particular horizontal, direction, a plurality of rotatable rail segments, wherein at least one thereof is transferable between an orientation in the first direction and an orientation in the second direction, at least one elevator cab, which is transportable along the guide rails and which, via the rotatable rail segments, is transferable between the different guide rails, at least one third guide rail, which is oriented in a third, in particular horizontal, direction, and wherein at least one of the rotatable rail segments is transferable between an orientation in the first or second direction into an orientation in the third direction.

15 Claims, 4 Drawing Sheets

(51) Int. Cl.
*B66B 1/26* (2006.01)
*B66B 1/24* (2006.01)
*B66B 20/00* (2006.01)

(52) U.S. Cl.
CPC ..... *B66B 1/2466* (2013.01); *B66B 1/2491* (2013.01); *B66B 7/022* (2013.01); *B66B 20/00* (2013.01); *B66B 2201/243* (2013.01); *B66B 2201/401* (2013.01)

(58) Field of Classification Search
CPC ... B66B 7/022; B66B 20/00; B66B 2201/243; B66B 2201/401
See application file for complete search history.

(56) References Cited

U.S. PATENT DOCUMENTS 5,235,144 A * 8/1993 Matsui ..... B66B 9/003 187/250
7,871,231 B2 * 1/2011 Oshima ..... B65G 47/54 198/349.1
10,370,221 B2 * 8/2019 Steinhauer ..... B66B 9/003
2007/0181374 A1 * 8/2007 Mueller ..... B66B 9/00 187/249
2011/0272215 A1 * 11/2011 Ach ..... B66B 11/0206 187/254
2017/0088396 A1 * 3/2017 Fargo ..... H02K 41/031
2017/0225927 A1 * 8/2017 Kirsch ..... B66B 11/0407
2018/0009636 A1 * 1/2018 Jedryczka ..... B66B 11/0407
2018/0257911 A1 * 9/2018 Gainche ..... B66B 7/02
2019/0177125 A1 * 6/2019 Gainche ..... B66B 7/026
2020/0002131 A1 * 1/2020 Bauer ..... B66B 1/3461
2020/0062548 A1 * 2/2020 Gainche ..... B66B 1/36

FOREIGN PATENT DOCUMENTS

CN 102264624 A 11/2011
DE 2 203 864 A 8/1973
DE 20 2004 009 022 U 9/2004
DE 10 2014 104 458 A 10/2015
DE 10 2014 220 966 A 4/2016
EP 0 615 946 A 9/1994
GB 918471 A 2/1963
WO 2011/098508 A 8/2011
WO 2015/144781 A 10/2015

* cited by examiner

ELEVATOR SYSTEM

CROSS REFERENCE TO RELATED APPLICATIONS

This application is a U.S. National Stage Entry of International Patent Application Serial Number PCT/EP2017/066141, filed Jun. 29, 2017, which claims priority to German Patent Application No. DE 10 2016 211 997.4, filed Jul. 1, 2016, the entire contents of both of which are incorporated herein by reference.

FIELD

The present disclosure generally relates to an elevator system.

BACKGROUND

DE 10 2014 220 966 A1 discloses an elevator system in which a plurality of elevator cabs are operated cyclical in a continuous operation, similarly to a paternoster. Unlike the traditional paternoster, each cab is driven independently from the other cabs and can thus stop independently from the other cabs at any chosen stopping point. Transfer devices are provided to transfer the cabs from a vertical direction of travel into a horizontal direction of travel, in order thus to be able to move the cab between different elevator shafts. The elevator cabs are in this way transportable in a single plane which are spanned by the two elevator shafts and by the transverse shafts which connect these.

Thus a need exists for an improved elevator system which is distinguished, in particular, by a versatile and efficient utilization of available installation space.

DETAILED DESCRIPTION

Figure 1:
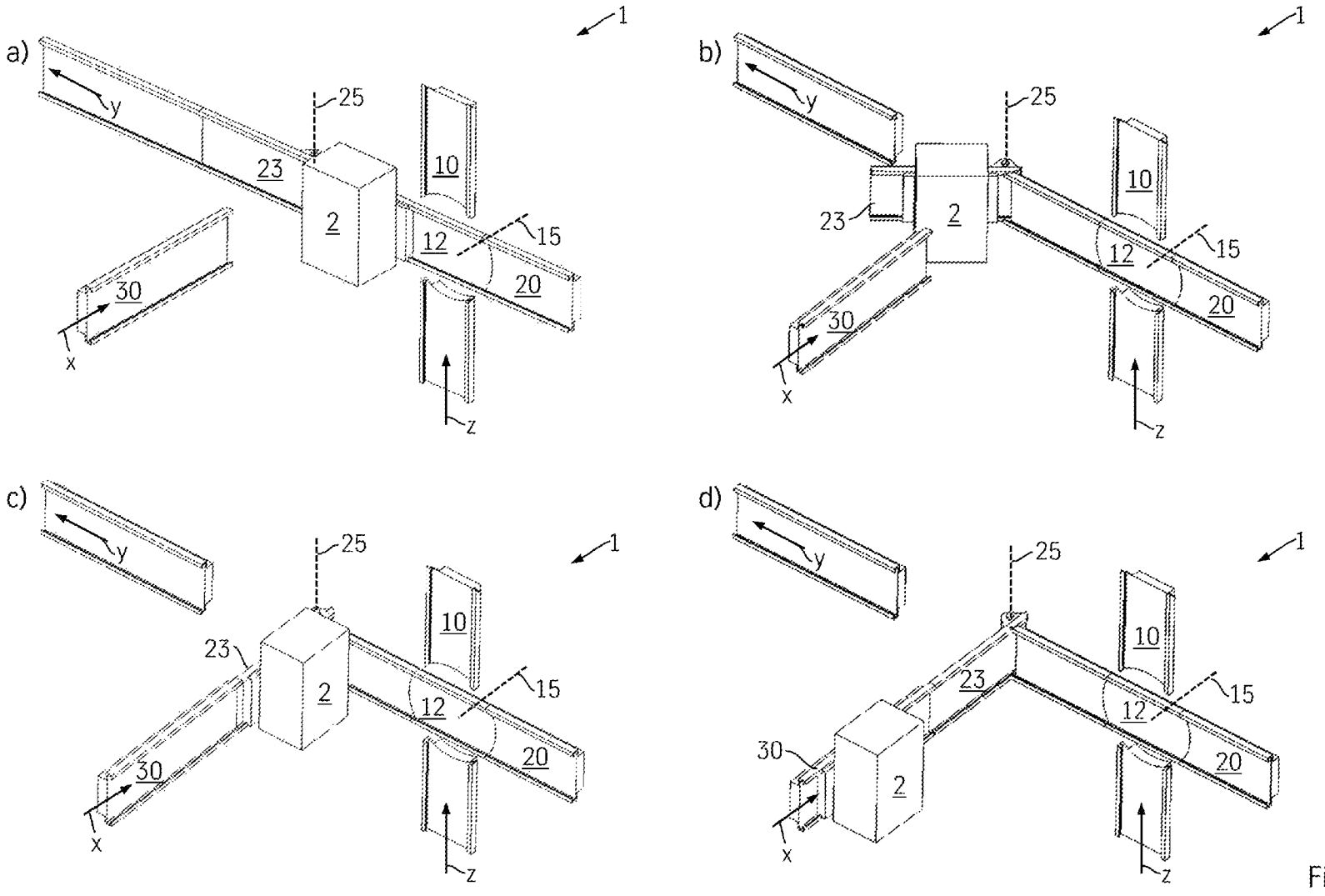
FIG. 1 is a partial view of an elevator system in different operating states.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The elevator system according to the invention comprises at least one first guide rail, which is oriented in a first, in particular vertical, direction, at least one second guide rail, which is oriented in a second, in particular horizontal, direction, and a plurality of rotatable rail segments. At least one of the rotatable rail segments is transferable between an orientation in the first direction and an orientation in the second direction. The elevator system comprises a plurality of elevator cabs, which are transportable along the guide rails and which, via the rotatable rail segments, are transferable between the different guide rails. The elevator system now further comprises a third guide rail, which is oriented in a third, in particular horizontal, direction. At least one of the rotatable rail segments is transferable between an orientation in the first or second direction into an orientation in the third direction.

In relation to the known elevator system, the elevator system according to the invention is distinguished by the prospect of a more efficient utilization of the installation space. The guide rails can thus also be disposed outside the plane which is spanned by the previous two directions. The enables a mobility of the cabs in three dimensions, while conventional elevator systems merely permit a two-dimensional transportability.

In particular, the three directions are differently oriented, the directions are consequently not parallel to one another. In one possible embodiment, the three directions are respectively oriented orthogonally to one another.

In particular, the first direction is vertically oriented, while the second and the third direction are respectively horizontally oriented. In one embodiment, by "vertically" and "horizontally" can respectively be understood "exactly vertically" and "exactly horizontally".

Preferably, the elevator system comprises a multidimensionally rotatable rail segment, which is transferable between an orientation in the first direction, an orientation in the second direction and an orientation in the third direction. This multidimensionally rotatable rail segment constitutes a type of universal switch, which allows unrestricted transferability in all three directions. This rail segment can be used at an intersection at which all three guide rails intersect.

The multidimensionally rotatable rail segment can be formed by virtue of the fact that one of the rotatable rail segments is arranged within the other rotatable rail segment. In concrete terms, this means, for example, that the first rotatable rail segment is arranged within the second rotatable rail segment, or the second rotatable rail segment within the first rotatable rail segment.

The invention is in particular applicable in elevator systems in which the elevator cab is guided on the guide rail with the aid of a backpack mounting. In the case of a backpack mounting, the rails which carry the cab are all located on one side of the cab. The cab is suspended, as it were, in a cantilevered manner, supported only on one side, in the elevator shaft. This mounting concept is distinguished by the fact that guide rails are disposed only on one side of the cab and therefore do little to hinder the free movement of the cab.

The first rotatable rail segment is preferably rotatable about a first rotational axis, which stands perpendicularly on a plane which is spanned by the first and the second guide rail. The second rotatable rail segment is preferably rotatable about a second rotational axis, which stands perpendicular to a plane which is spanned by the second and the third guide rail.

In particular, the guide rails, at least in the region of the rotatable rail segments, are configured in a straight line, in particular at a distance of at least 2 meters from the rotatable rail segment.

Preferably, in a first variant, to at least one of the rotatable rail segments, in particular the second rotatable rail segment, is assigned at least one stator unit of a linear motor. The stator unit is pivotable with the rotatable rail segment.

Preferably, in a second variant, to at least one of the rotatable rail segments, in particular the second rotatable rail segment, is assigned at least one stator unit of a linear motor. The stator unit is not pivotable with the rotatable rail segment; in particular, stator unit is mounted in a rotationally secure manner in the elevator shaft of the elevator system. By the second variant, an improved access to the rear side of the car is created. For maintenance purposes over a short distance, the method can also be realized manually.

If within the scope of the present invention there is question of a transferal from one guide rail to another guide rail being possible via a rotatable rail segment, then this in principle also incorporates transferal in the reverse direction.

FIG. 1 shows parts of an elevator system 1 according to the invention in different operating states. The elevator system 1 comprises a first guide rail 10, along which an elevator cab 2 is guided with the aid of a backpack mounting. The first guide rail 10 is oriented vertically in the z-direction and enables the elevator cab 2 to be transportable between different floors.

The elevator system 1 comprises a second guide rail 20, along which the elevator cab 2 is guided with the aid of the backpack mounting. The second guide rail 20 is oriented horizontally in the y-direction and enables the elevator cab 2 to be transportable within one floor, in particular also for transferal from one vertical guide rail 10 to another vertical guide rail (not shown) in order to conduct a modern paternoster operation.

Via a first rotatable rail segment 12, the elevator cab 2 is transferable from the first guide rail 10 to the second guide rail 20. The first rotatable rail segment 12 is rotatable with respect to a first rotational axis 15, which lies perpendicular to a y-z plane spanned by the first and the second guide rail 10, 20.

The elevator system further comprises a third guide rail 30, along which the elevator cab 2 is guided in a backpack mounting. The third guide rail 30 is likewise oriented horizontally, but in a third direction x, and enables the elevator cab 2 to be transportable within one floor, but transversely to the other horizontal direction y.

Via a second rotatable rail segment 23, the elevator cab 2 is transferable from the second guide rail 20 to the third guide rail 30. The second rotatable rail segment 23 is rotatable with respect to a second rotational axis 25, which lies perpendicular to a y-x plane spanned by the second and the third guide rail 20, 30.

The provision of the third guide rail 30 can be utilized in a variety of ways. Thus the third guide rail 30 can lead into a parking area, in which the elevator cab 2 can be parked (including for maintenance purposes). The third guide rail 30 can serve to establish a connection between two vertical elevator shafts, the guide rails of which are not disposed in a common y-z plane. Remote regions within a building are thereby able to be interlinked in a variety of ways by means of a single elevator system 1. Spatially very complex travel movements of a single elevator cab are thereby able to be produced.

Figure 2:
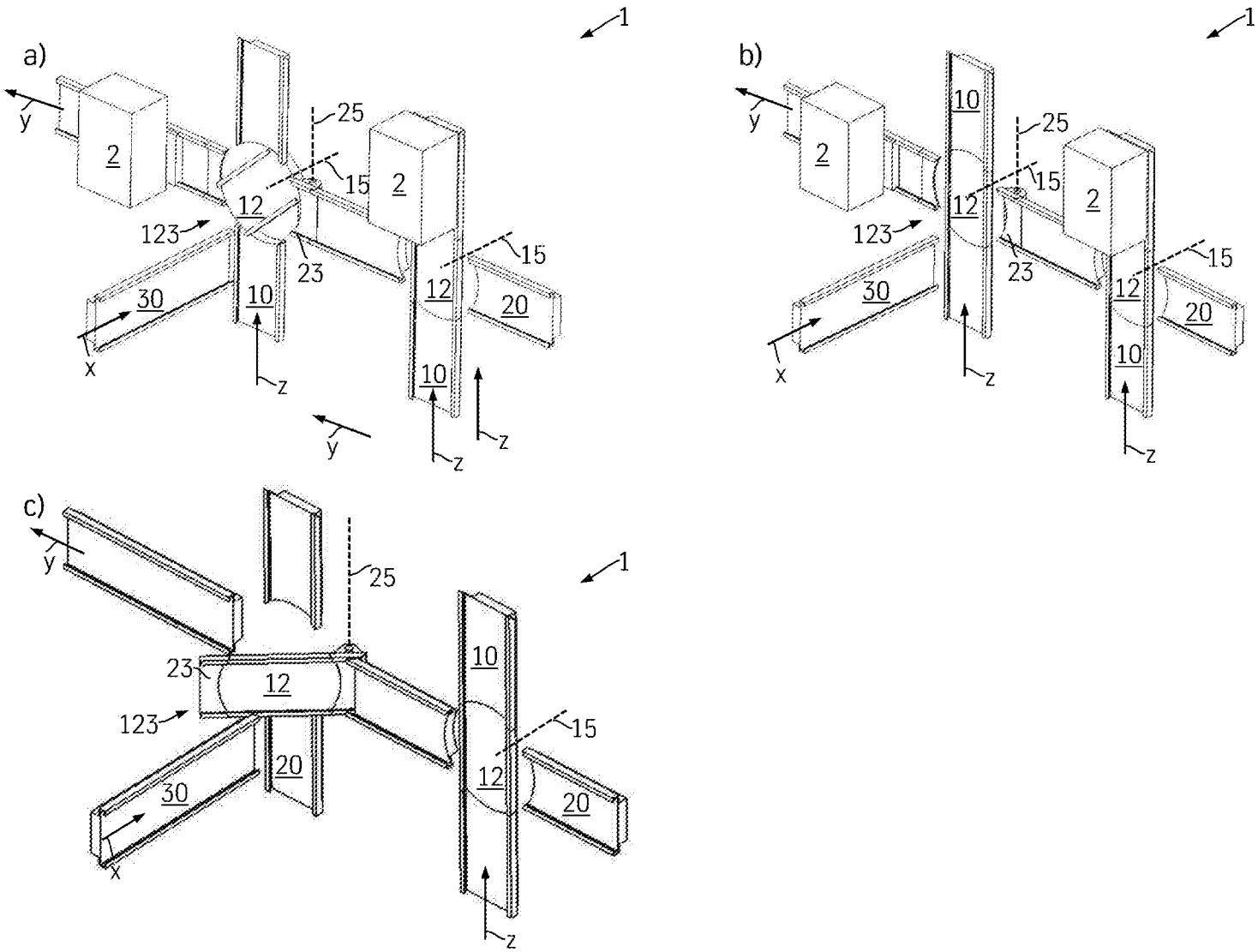
FIG. 2 is a partial view of an elevator system in different operating states.

FIG. 2 shows a refinement of the elevator system according to FIG. 1; below. Only the essential differences from the elevator system according to FIG. 1 are described.

In the region of the second rotatable rail segment 23, a further first vertical guide rail 10 is additionally provided. In addition, within the second rotatable rail segment 23 is integrated a first rotatable rail segment 12. As a result, a multidirectionally rotatable rail segment 123, which interconnects all three guide rails 10, 20, 30 at a junction, is formed. On the multidirectionally rotatable rail segment 123, the elevator cab 2 can now selectively be transferred from the first guide rail 10 to the second guide rail 20, from the first guide rail 10 to the third guide rail 30, or from the second guide rail 20 to the third guide rail 30. This multidirectionally rotatable rail segment 123 consequently comprises two rotatable rail segments 12, 23.

Figure 3:
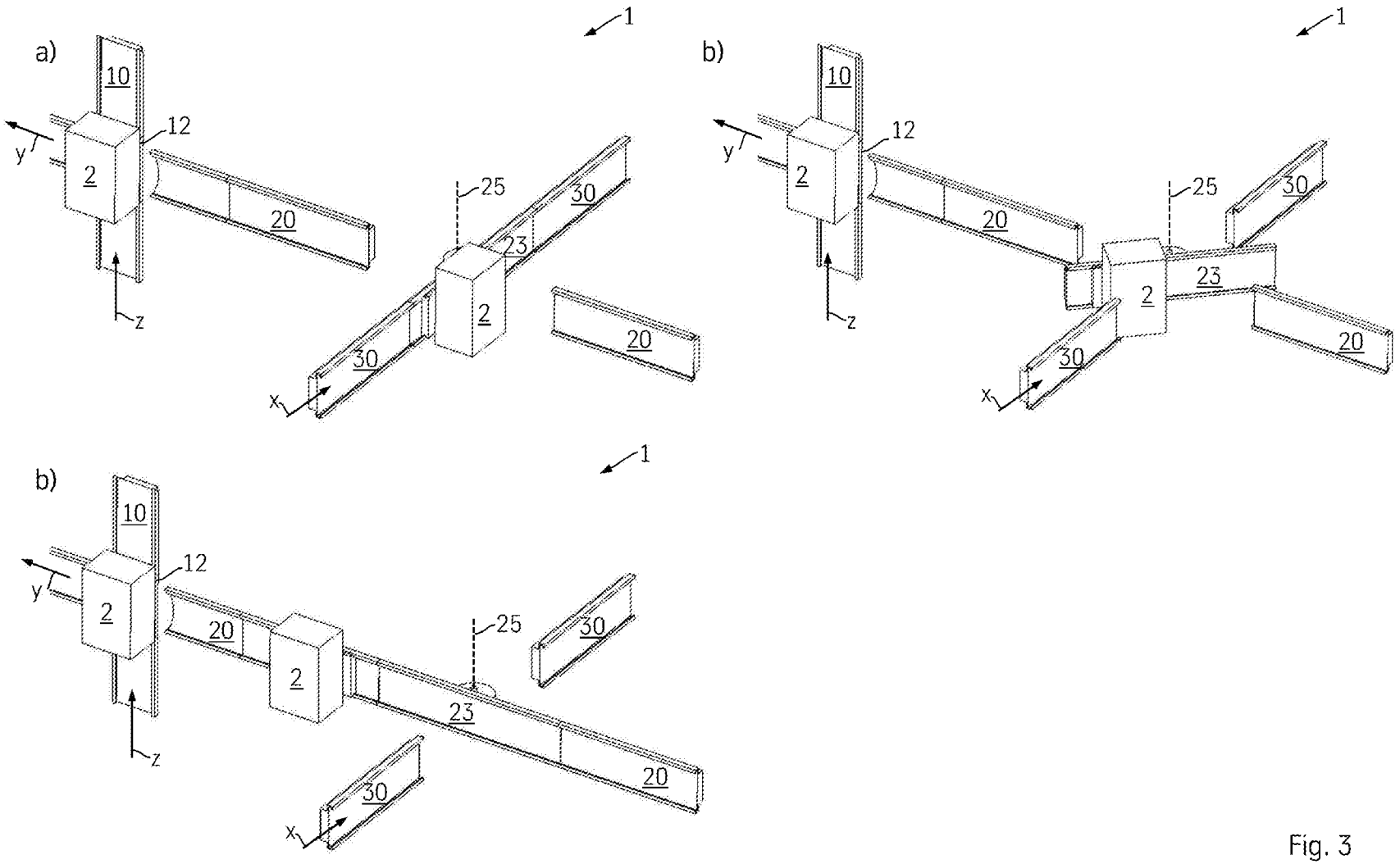
FIG. 3 is a partial view of an elevator system in different operating states.

FIG. 3 shows a refinement of the elevator system according to FIG. 1; below, only the essential differences from the elevator system according to FIG. 1 are described.

The second rotatable rail segment 23 is configured such that an intersection between the second and the third rail segment 20, 30 is formed, i.e. a cab 2 can pass through the rotatable rail segment 23 both in the second, in particular horizontal, direction y and in the third, in particular horizontal, direction x, respectively assuming the correct rotary position of the second rotatable rail segment 23.

In FIGS. 1 to 3, the rails or rail segments have been shown in simplified representation. Not shown is that the cars are there driven by a linear drive comprising stator units. The stator units are fixedly installed in the elevator shaft; at least one rotor unit is firmly attached to the respective car.

Figure 4:
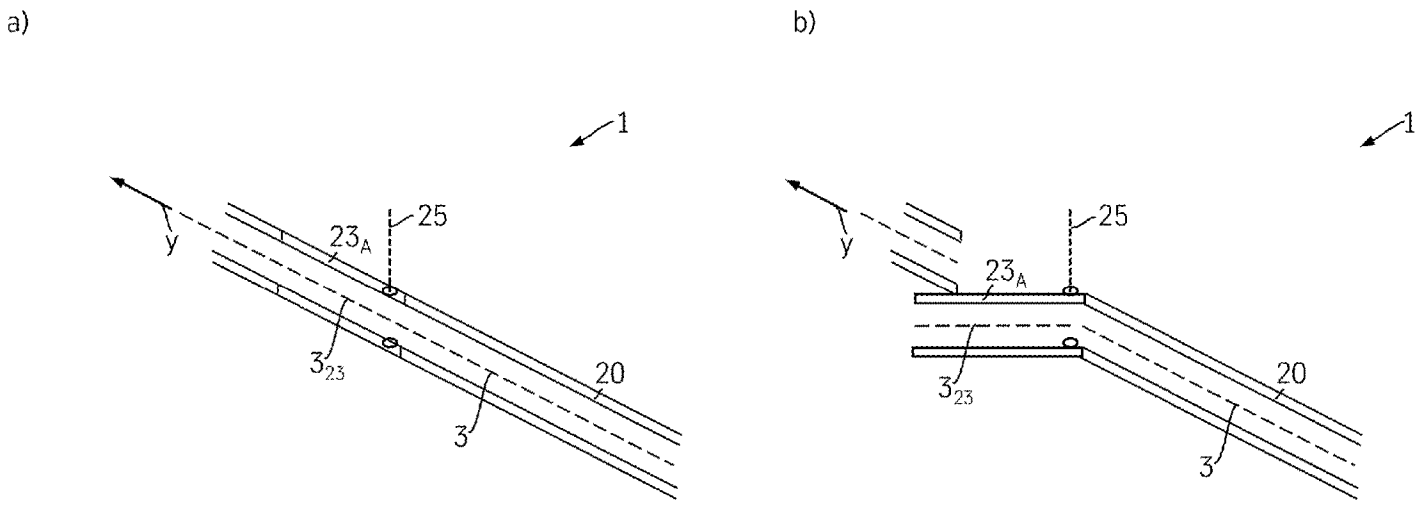
FIG. 4 is a partial view of a rotatable rail segment of an elevator system according to the disclosure.
Figure 5:
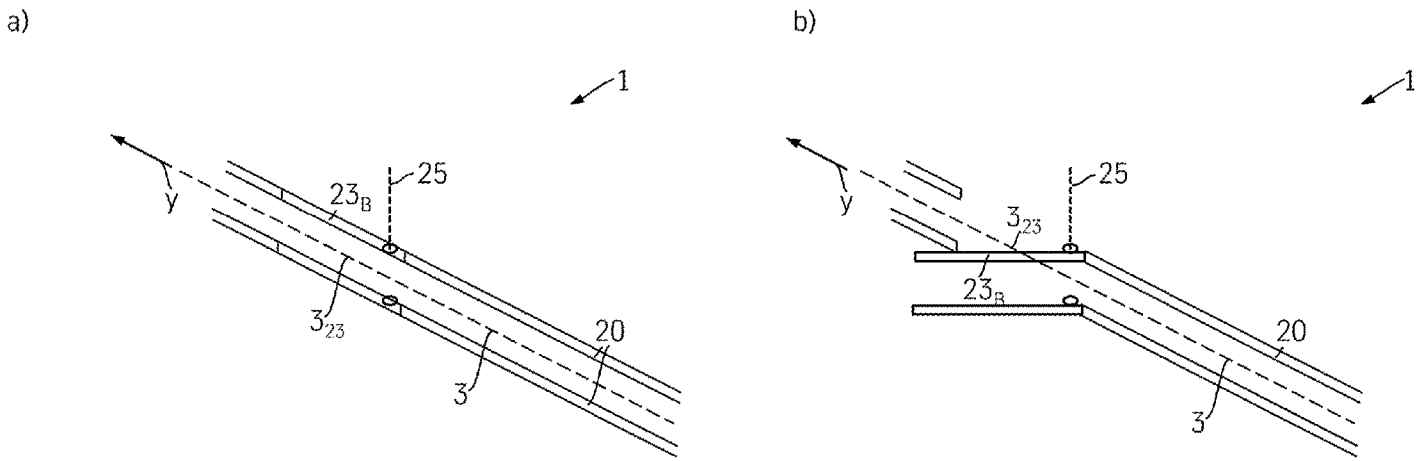
FIG. 5 is a partial view of a rotatable rail segment of an elevator system according to the disclosure.

In FIGS. 4 and 5, such stator units 3 of the linear drive are now shown in simplified representation. In order to drive the car, the stator units 3 are arranged distributed over the totality of the rails.

FIG. 4 here shows a first variant of a rotatable rail segment $\mathbf{23}_A$, wherein to the rotatable rail segment $\mathbf{23}_A$ are assigned stator units $\mathbf{3}_{23}$. The assigned stator units $\mathbf{3}_{23}$ are here pivotable with the rotatable rail segment. A car which is found on the rotatable rail segment is drivable, irrespective of the rotary position of the rotatable rail segment, by the assigned stator units $\mathbf{3}_{23}$.

FIG. 5 now shows a second variant of a rotatable rail segment $\mathbf{23}_B$, wherein to the rotatable rail segment $\mathbf{23}_B$ are likewise assigned stator units $\mathbf{3}_{23}$. In contrast to the first variant according to FIG. 4, the assigned stator units $\mathbf{3}_{23}$ are not pivotable. A car which is found on the rotatable rail segment $\mathbf{23}_B$ is now drivable only in a first rotary position (FIG. 5*a*), no longer in the other rotary position (FIG. 5*b*).

However, this second variant provides improved access to the car from the rear side of the car. On the rear side of the car are disposed, in particular, high-maintenance components or wearing parts. The second variant now provides on the rear side a type of maintenance area, similar to a service pit in a vehicle workshop. Thus the car can here be swung out by the rotatable rail segment and, whereby the access to the rear side of the car is freed.

Assigned means in this context: The stator units $3_{23}$ assigned to the rotatable rail segment 23 are at least temporarily capable of and designed for driving a car disposed on the rotatable rail segment 23. This applies both to the first and the second variant

REFERENCE SYMBOL LIST

1 elevator system
2 elevator cab
3 stator unit
10 first guide rail
12 first rotatable rail segment
123 multidimensionally rotatable rail segment
15 first rotational axis
20 second guide rail
23 second rotatable rail segment
25 second rotational axis
30 third guide rail
z first direction
y second direction
x third direction

What is claimed is:

1. An elevator system, comprising:

a first guide rail oriented in a first direction, a second guide rail oriented in a second direction, a plurality of rotatable rail segments, wherein at least one of the plurality of rotatable rail segments is configured to transfer between an orientation in the first direction and an orientation in the second direction, an elevator cab configured to move along the guide rails and which, via the plurality of rotatable rail segments, is configured to transfer between the first and second guide rails, and a third guide rail oriented in a third direction, wherein at least one of the plurality of rotatable rail segments is configured to transfer between an orientation in the first or second direction into an orientation in the third direction.

2. The elevator system as claimed in claim 1, wherein the three directions do not stand parallel to one another.

3. The elevator system as claimed in claim 1, wherein the three directions are oriented orthogonally to one another.

4. The elevator system of claim 1, wherein one of the plurality of rotatable rail segments is a multidimensionally rotatable rail segment, which is configured to transfer between an orientation in the first direction, an orientation in the second direction and an orientation in the third direction.

5. The elevator system of claim 4, wherein the multidimensionally rotatable rail segment is formed by an arrangement of one of the plurality of rotatable rail segments within another of the plurality of rotatable rail segments.

6. The elevator system of claim 4, wherein the multidimensionally rotatable rail segment is formed by an arrangement of a first rotatable rail segment within a second rotatable rail segment or an arrangement of the second rotatable rail segment within the first rotatable rail segment.

7. The elevator system of claim 6, wherein the first rotatable rail segment is rotatable about a first rotational axis, which stands perpendicular to a plane which is spanned by the first and the second guide rail.

8. The elevator system of claim 7, wherein the second rotatable rail segment is rotatable about a second rotational axis, which stands perpendicular to a plane which is spanned by the second and the third guide rail.

9. The elevator system of claim 6, wherein at least one of the plurality of rotatable rail segments is assigned at least one stator unit of a linear motor, wherein the stator unit is pivotable with the at least one of the plurality of rotatable rail segments.

10. The elevator system of claim 9, wherein the at least one of the plurality of rotatable rail segments is the second rotatable rail segment.

11. The elevator system of claim 6, wherein at least one of the rotatable rail segments is assigned at least one stator unit of a linear motor, wherein the stator unit is not pivotable with the at least one of the plurality of rotatable rail segments.

12. The elevator system of claim 11, wherein the at least one of the rotatable rail segments is the second rotatable rail segment.

13. The elevator system of claim 11, wherein the stator unit is mounted in a rotationally secure manner in the elevator shaft of the elevator system.

14. The elevator system of claim 1, wherein the first direction is vertical, the second direction is horizontal, and the third direction is horizontal.

15. The elevator system of claim 1, wherein the elevator cab is guided on the guide rails via a backpack mounting.

* * * * *